United States Patent [19]

Yasumoto

[11] Patent Number: 4,792,312

[45] Date of Patent: Dec. 20, 1988

[54] ADAPTOR FOR EFFECTING A TIGHT BEND IN A COAXIAL CABLE

[75] Inventor: Hiromi Yasumoto, Iruma, Japan

[73] Assignee: Junkosha Co., Ltd., Tokyo, Japan

[21] Appl. No.: 91,540

[22] Filed: Aug. 31, 1987

[30] Foreign Application Priority Data

Nov. 29, 1986 [JP] Japan ..... 61-185420[U]

[51] Int. Cl.[4] ..... H01E 25/00

[52] U.S. Cl. ..... 439/640; 439/578; 439/164

[58] Field of Search ..... 439/466, 468, 162, 163, 439/164, 640, 641, 643, 648, 376, 1, 6, 10, 11, 13, 596, 586, 588, 592, 675, 63, 502, 506, 668, 669, 578, 585

[56] References Cited

U.S. PATENT DOCUMENTS

| | | | |
|---|---|---|---|
| 2,067,844 | 1/1937 | Birdseye | 439/6 |
| 2,118,785 | 5/1938 | Birdseye et al. | 439/6 |
| 3,480,722 | 11/1969 | Van Horssen et al. | 439/582 |
| 3,528,052 | 9/1970 | Brishka | 439/582 |
| 4,227,765 | 10/1980 | Neumann et al. | 439/578 |
| 4,599,483 | 7/1986 | Kuhn et al. | 439/502 |

FOREIGN PATENT DOCUMENTS

| | | | |
|---|---|---|---|
| 800993 | 9/1958 | United Kingdom | 439/502 |

*Primary Examiner*—David Pirlot

*Attorney, Agent, or Firm*—Mortenson & Uebler

[57] ABSTRACT

An adaptor is provided for effecting a small radius-of-curvature bend in a relatively large diameter coaxial cable. The adaptor comprises a central, preferably plastic, bellows-like protective element, at either end of which is attached a connector for attachment externally to a relatively large diameter coaxial cable, each connector attached internally to a flexible, relatively small diameter coaxial cable which extends from one connector to the other connector through the protective bellows-like element. Because of the bellows-like element and the relatively small diameter of the flexible coaxial cable in the adaptor, a small radius-of-curvature effective bend in the relatively large diameter coaxial cable assembly can be achieved without significant transmission losses.

4 Claims, 1 Drawing Sheet

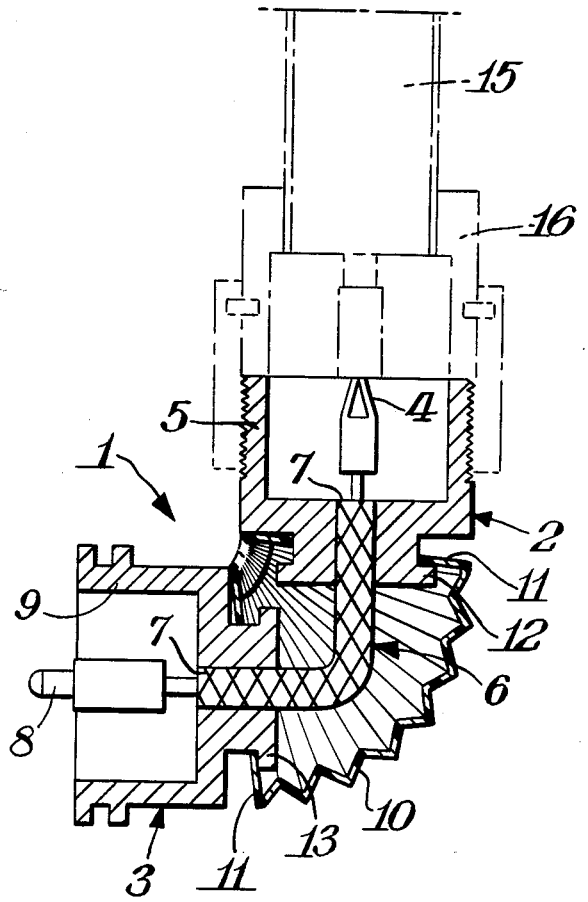
15
16
5
4
1
7
2
11
9
12
7
6
8
10
13
3
11

ADAPTOR FOR EFFECTING A TIGHT BEND IN A COAXIAL CABLE

BACKGROUND OF THE INVENTION

The present invention relates to an adaptor for a coaxial cable, for example, for a large diameter, high-frequency type coaxial cable which has low-loss characteristics, the adaptor allowing the cable to be bent with low radius of curvature at a connection point.

Generally, a flexible coaxial cable cannot be bent with the radius of curvature below a certain allowable radius. This condition is dictated by the high-frequency transmission characteristics of the cable and its geometry. However, as is described in Japanese Patent Publication (Kokai) No. 56-94,802, in order to eliminate transmission noise, even with the radius of curvature within the allowable minimum value, the bent portion of the cable conventionally should be maintained rigid.

Because, in the case of a low-loss, high-frequency type coaxial cable, the central conductor has a relatively large outside diameter, the cable itself has a relatively large outside diameter; and therefore, its minimum radius of curvature is large as well. If, under these conditions, the bendable portion of the cable is made rigid, it would be difficult to provide highly efficient space utilization in the electronic device or machine in which the cable is used.

It is an object of the present invention to eliminate disadvantages inherent in the conventional coaxial cable and to provide an adaptor which makes it possible to obtain small radius of curvature, even with coaxial cables of large diameters.

SUMMARY OF THE INVENTION

An adaptor for effecting a small radius-of-curvature bend in a relatively large diameter coaxial cable is provided comprising a central, bellows-like protective element connected at each of its ends to a coaxial connector for external attachment to a relatively large diameter coaxial cable, each connector attached internally to a flexible, relatively small diameter coaxial cable which extends from one connector to the other connector longitudinally through the bellows-like protective element, whereby, because of the bellows-like element and the relatively small diameter of the flexible coaxial cable within the adaptor, a small radius-of-curvature effective bend in the relatively large diameter coaxial cable assembly is achieved.

BRIEF DESCRIPTION OF THE DRAWINGS

The drawing shows a side elevational view, partly in cross section, of a coaxial cable adaptor made in accordance with one embodiment of the invention.

DETAILED DESCRIPTION OF THE INVENTION AND PREFERRED EMBODIMENTS WITH REFERENCE TO THE DRAWINGS

An adaptor is provided for effecting a small radius-of-curvature bend in a relatively large diameter coaxial cable. The adaptor comprises a central, preferably plastic, bellows-like protective element, at either end of which is attached a connector for attachment externally to a relatively large diameter coaxial cable, each connector attached internally to a flexible, relatively small diameter coaxial cable which extends from one connector to the other connector through the protective bellows-like element. Because of the bellows-like element and the relatively small diameter of the flexible coaxial cable in the adaptor, a small radius-of-curvature effective bend in the relatively large diameter coaxial cable assembly can be achieved without significant transmission losses.

More specifically according to the invention, the above purpose is achieved by providing an adaptor for a coaxial cable comprising coaxial connectors on both sides of the protective element, the connectors having large diameters at their external ends for connection to large diameter coaxial cables, and small diameters at their internal ends for connection to a flexible, small diameter coaxial cable which is installed between the connectors and is electrically connected to their internal ends, the protective element surrounding the flexible, small diameter coaxial cable and providing a certain space from outside and attached at both ends to the internal portions of the connectors.

Because the space between the coaxial connector on one side of the adaptor and the coaxial connector on the other side of the adaptor is spanned by a flexible, small diameter coaxial cable which is maintained in electrical contact with both connectors, the cables being connected may have, instead of their direct interconnection, a diameter which is substantially larger than the allowable minimum radius of curvature. In addition, the bent portion need not be rigid and can be freely bent in any required direction.

The large diameter coaxial cable and the flexible, small diameter coaxial cable may have characteristic impedances matched to each other.

In general, the flexible, small diameter coaxial cable of the adaptor may cause a certain transmission loss, but, because the length of this small diameter cable is very short, the share of this loss in the total system will be insignificant.

A detailed description of the invention is best provided with reference to the drawing.

The figure shows a longitudinal sectional view of a coaxial cable adaptor 1 made in accordance with one embodiment of the present invention.

Coaxial cable adaptor 1 shown in the drawing has at its one end a coaxial connector 2 of a female type, and, on the other end, a coaxial connector 3 of a male type.

In view of the above, one side of the adaptor is provided with a female type pin 4 which is surrounded by an outer conductor connection sleeve 5 so that a space is formed between the sleeve and pin 4. The sleeve has a large diameter at its front portion and a smaller diameter at the rear portion. In addition, it is maintained in electrical contact with an outer conductor 7 of a flexible, small diameter coaxial cable 6, the characteristic impedance of which is matched with that of the sleeve. In a similar manner, coaxial connector 3 has a male type pin 8 at the center of its external end. Male pin 8 is surrounded by an outer conductor connection sleeve 9 which has a large diameter at its external end and a reduced diameter at its internal end. Connection sleeve 9 is maintained in electrical contact with the outer conductor 7 of the above mentioned flexible, small diameter coaxial cable 6. The core conductor of flexible, small diameter coaxial cable 6 electrically connects female pin 4 and male pin 8 located on both external ends of coaxial connectors 2 and 3, repectively.

From outside, flexible, small diameter coaxial cable 6 is protected by a protective element 10 which houses cable 6 within a surrounding space and is formed as a caterpillar-like bellows. Protective element 10, preferably made of plastic, has at its both ends ring-shaped portions 11 which are engaged with supporting flanges 12 and 13 on connectors 2 and 3, respectively, as shown. Protective element 10 could also be made of rubber or even kraft paper in some cases.

When adaptor 1 of the present invention is attached, for example, to a large diameter coaxial connector 16 located at the end of a large diameter coaxial cable 15, as shown in phantom, the cable can be bent at the place of it connection by 90°, as shown in the attached drawing, or can be bent in the direction perpendicular to the plane of the drawing.

Because, in the bent state, the radius of curvature of the cable does not exceed the allowable minimum, it does not lose its transmission characteristics. because coaxial cable 6 of adaptor 1 has a very small diameter, it may have certain transmission losses, which, however, are insignificant compared to the total transmission loss in view of a very short length of the small diameter cable.

Thus, it has been shown that the present invention provides an adaptor for a coaxial cable which comprises coaxial connectors on both sides of a central protective element. The connectors have large diameters at their external ends for connection to large diameter cables, and small diameters at their internal ends for connection to a flexible, small diameter coaxial cable which is installed between the connectors and is electrically connected to their internal ends. The protective elements surrounds the above mentioned flexible, small diameter coaxial cable within a certain space from outside. It is attached at both ends to the internal ends of the connectors. The effect of such a construction is that it occupies a very small space in an assembly of coaxial cables having large diameters. This, in turn, improves compactness of a corresponding electronic device or machine.

While the invention has been disclosed herein in connection with certain embodiments and detailed description, it will be clear to one skilled in the art that modifications or variations of such details can be made without deviating from the gist of this invention, and such modifications or variations are considered to be within the scope of the claims hereinbelow.

What is claimed is:

1. An adaptor for effecting a small radius-of-curvature bend in a relatively large diameter coaxial cable comprising a central, bellows-like protective element having two ends, said bellows-like protective element connected at each of its ends to a coaxial connector for external attachment to a relatively large diameter coaxial cable, each connector attached internally to a flexible, relatively small diameter coaxial cable which extends from one said connector to the other said connector through said bellows-like protective element, when said adaptor is connected to said large diameter coaxial cable the outer conductor of said large diameter coaxial cable maintained in electrical contact with the outer conductor of said small diameter coaxial cable and the inner conductor of said large diameter coaxial cable maintained in electrical contact with the inner conductor of said small diameter coaxial cable through said bellows-like protective element, said large diameter coaxial cable and said small diameter coaxial cable having matched characteristic impedances, whereby, because of the bellows-like element and the relatively small diameter of the flexible coaxial cable within the adaptor, a small radius-of-curvature effective bend in the relatively large diameter coaxial cable assembly is achieved.

2. The adaptor of claim 1 wherein said bellows-like protective element is plastic.

3. The adaptor of claim 1 wherein said bellows-like protective element is rubber.

4. The adaptor of claim 1 wherein said bellows-like protective element is kraft paper.

* * * * *